US006690292B1

(12) United States Patent
Meadows et al.

(10) Patent No.: US 6,690,292 B1
(45) Date of Patent: Feb. 10, 2004

(54) METHOD AND SYSTEM FOR MONITORING VEHICULAR TRAFFIC USING A WIRELESS COMMUNICATIONS NETWORK

(75) Inventors: Vernon Meadows, Lilburn, GA (US); Samuel N. Zellner, Dunwoody, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 217 days.

(21) Appl. No.: 09/587,801

(22) Filed: Jun. 6, 2000

(51) Int. Cl.[7] ..... G08G 1/09

(52) U.S. Cl. ..... 340/905; 340/910; 340/937

(58) Field of Search ..... 340/988, 905, 340/933, 990, 995, 910, 937; 701/117, 118, 119; 455/412

(56) References Cited

U.S. PATENT DOCUMENTS 5,349,520 A * 9/1994 Hickman ..... 342/118
5,396,429 A * 3/1995 Hanchett ..... 340/910
5,850,190 A * 12/1998 Wicks et al. ..... 340/7.48
5,889,477 A * 3/1999 Fastenrath ..... 340/2.7
6,253,146 B1 * 6/2001 Hanson et al. ..... 340/905
6,297,748 B1 * 10/2001 Lappenbusch et al. ..... 340/905
6,304,816 B1 * 10/2001 Berstis ..... 340/905
6,353,792 B1 * 3/2002 Murthy ..... 455/412
6,384,739 B1 * 5/2002 Roberts, Jr. ..... 340/905
6,466,862 B1 * 10/2002 DeKock et al. ..... 340/905

OTHER PUBLICATIONS http://www.traffic.com.

* cited by examiner

*Primary Examiner*—Van Trieu
(74) *Attorney, Agent, or Firm*—Shaw Pittman LLP

(57) ABSTRACT

A traffic monitoring system that provides vehicular traffic information is described. A plurality of motion sensors for detecting speed of traffic information are placed along one or more roadways. The motion sensors transmit the detected information over a wireless network at periodic intervals. The information is received and communicated to a database, which is accessible for providing speed of traffic information detected by a selected portion of the motion sensors. Users can request and receive traffic information through mobile communications units such as mobile cellular telephones, personal display assistants, or interactive pagers, or through an internet connection. Traffic information can be combined with mapping and routing information to determine optimal commuting routes.

29 Claims, 7 Drawing Sheets

STARTING ADDRESS: 1155 PEACH TREE STREET, ATLANTA, GEORGIA

DESTINATION ADDRESS: 219 MEADOWS ROAD, ATLANTA, GEORGIA

THE TRAFFIC ALERT SYSTEM IDENTIFIES THREE (3) POSSIBLE ROUTES
THE SUGGESTED ROUTE IS PROVIDED IN BOLD

METHOD AND SYSTEM FOR MONITORING VEHICULAR TRAFFIC USING A WIRELESS COMMUNICATIONS NETWORK

FIELD OF THE INVENTION

The present invention relates to wireless communications systems, and more particularly, to a wireless communications system for monitoring automotive traffic from remote locations.

BACKGROUND OF THE INVENTION

In almost every metropolitan region, automobile traffic congestion is identified as one of the greatest obstacles to economic growth, productivity, and quality of life for area commuters. Despite the interminable efforts of city planners to improve roadwork and highway systems, new roads always eventually result in increased traffic that ultimately exceeds the intended capacity. In the attempt to avoid insufferable delays, many commuters rearrange their commuting schedule or otherwise travel by alternative routes when there is known to be a traffic backup. However, it is generally difficult for drivers to make alternate commuting plans because adequate traffic congestion information is not available to drivers at the times when needed.

There are several resources available that are intended to assist drivers' daily commutes by providing traffic information. In most cities, news radio stations periodically broadcast traffic reports during the "rush hour," which can alert drivers to traffic accidents and congestion in certain areas. In some locations, computerized overhead displays are placed on major roads or highways that flash messages to warn drivers of road closings or accidents that are just ahead. To assist drivers in locating alternative routes, GPS systems are now available in automobiles to show point-to-point directions on a mapped display.

While radio traffic reports and programmable signs provide useful information to commuters, these resources cannot be customized for an individual driver's commute, and therefore have only a limited effect. The GPS systems are invaluable for providing directions for alternate routes, but fail to provide any information about the expected traffic for any of the routes. Presently, there is a need for a system that monitors automotive traffic and can be customized by drivers to provide detailed information about the traffic conditions at particular, specified locations.

SUMMARY OF THE INVENTION

The traffic monitoring system of the present invention provides information about the speed of traffic in a specified location in response to user requests. Users can access customized traffic information on demand and then plan a commuting route that avoids unnecessary traffic delays.

The present invention uses a plurality of motion sensors that detect speed of traffic information at a given location along one or more roadways. The motion sensors transmit the detected information over a wireless network at periodic intervals. The information is received and communicated to a database, which is accessible for providing speed of traffic information detected by a selected portion of the motion sensors.

Users can request and receive traffic information through mobile communications units such as mobile cellular telephones, personal display assistants, or interactive pagers, or through an internet connection. Traffic information can be combined with mapping and routing information to determine optimal commuting routes.

The present invention includes motion sensors for monitoring the flow of vehicular traffic along a roadway. The motions sensors include a central processing unit, a transmitter, and a motion sensing detector. The motion sensor transmits speed of traffic information detected by the detector on a wireless network.

The present invention is also directed to a method for providing vehicular traffic information according to a specified traffic request. The traffic monitoring system receives speed of traffic information transmitted by a plurality of motion sensors located along one or more roadways corresponding to the specified traffic request. The traffic information is stored in a database. The system determines the traffic information corresponding to the specified traffic request and communicates the traffic information.

The traffic monitoring system according to the present invention also provides vehicular traffic information over the Internet. A database stores vehicular traffic information for a plurality of roadways. An Internet server communicates the vehicular traffic information, wherein the database provides traffic information concerning specified geographical locations in response to traffic information requests to users through an Internet-capable communications interface. The system can also determine at least one geographical route for travelling from a starting location to a destination location over navigable roadways. The geographical route is mapped and the traffic information is overlaid on the map along with the at least one geographical route.

Figure 1:
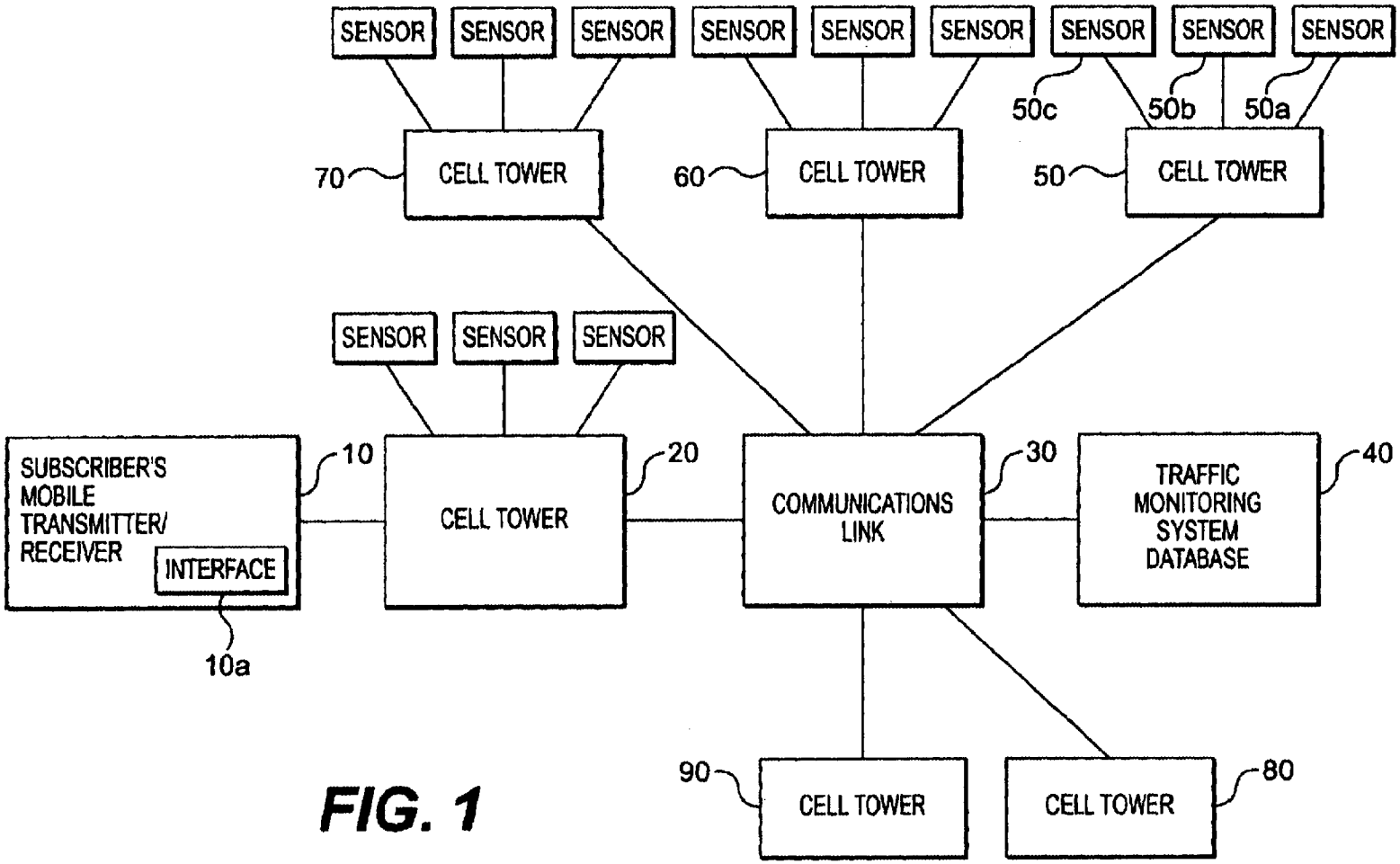
FIG. 1 is a schematic diagram of a traffic monitoring system according to the preferred embodiment of the present invention.

DETAILED DESCRIPTION OF THE PREFERRED EMBODIMENTS ACCORDING TO THE PRESENT INVENTION

The traffic monitoring system of the present invention enables a subscriber to access traffic information concerning a particular roadway, route, or intersection from a remote location through a wireless communications system. The traffic information is gathered from a plurality of sensor units that are located along roadways to detect the average speed of traffic during given time periods. The sensor units periodically send information signals over a wireless network, which are received by a central database. Subscribers can access the database while travelling via mobile communications units, such as cell phones, personal display assistants (PDA's), interactive pagers, laptops, or systems that may become integrated into automobiles. Depending upon the capabilities of the user interface provided in the mobile communications unit, the subscriber can request information regarding a current location or a destination location, and receive traffic updates, average speed information, suggested alternative routes, estimated arrival time, etc.

The traffic monitoring system according to the preferred embodiment of the present invention is described with reference to the schematic diagram in FIG. 1. A mobile transmitter/receiver 10 is used by a subscriber to the system to request and receive traffic information through user interface 10*a*. The traffic information is maintained in a traffic monitoring system database 40. The mobile transmitter/receiver 10 can be a portable handset, such as a cellular telephone, an interactive pager, a personal display assistant (PDA), or any other portable computer system, such as a laptop. The mobile transmitter/receiver can also be incorporated as a fixed unit in an automobile, and may be part of an automobile GPS system. The operability and level of functionality of the mobile transmitter/receiver 10 depends upon the capabilities of the user interface 10*a* provided in the unit.

In the preferred embodiment, the mobile transmitter/receiver 10 communicates with the traffic monitoring system database 40 through a cell tower 20. Generally, wireless networks operate by establishing a communications link over radio waves between a mobile transmitter/receiver and a network transmitter/receiver located in the general vicinity of the mobile transmitter/receiver. Network transmitters/receivers each provide coverage for a limited geographical region, or cell, and are usually located near the center of the respective region on a cell tower. As a mobile transmitter/receiver moves across different regions during a wireless communication, e.g., in an automobile, the communication is transferred from one cell tower to the next. The network transmitters/receivers on the respective cell towers are connected to base stations that provide a communications link to other network transmitters/receivers or landline network systems.

Cell tower 20 establishes a communications link between mobile transmitter/receiver 10 and traffic monitoring system database 40 through communications link 30. Communications link 20 can include one or more base stations and all other known components necessary for wireless networks. If the traffic monitoring system database 40 is not part of the wireless network, the communications link 30 also includes landline connections and all other known components necessary for a wired network.

FIG. 1 shows a plurality a cell towers 20, 50, 60, 70, 80, 90 that are each connected to communications link 30. Many, but not necessarily all of the cell towers have one or more sensors that are physically located within the cell region of the respective cell tower. For example, cell tower 50 communicates with sensors 50*a*–50*c*. The sensors are physically located on or near a roadway to detect the flow of traffic at a location of interest, as will be described in further detail below.

The traffic monitoring system database 40 stores the information transmitted from each of the sensors that are part of the traffic monitoring system. The transmitted information may be a value for the speed of traffic. As an alternative, the sensors may transmit a code indicating whether the speed of traffic is normal. This qualitative assessment could be determined according to a fixed reference value, or by evaluating a history of previous readings detected by the sensor. The calculation could be performed either by the sensor or within the database.

In the preferred embodiment, the traffic monitoring system database 40 is a centralized unit that organizes the data for use by subscribers. The database may also include a field for storing the time of the last data update for each sensor. The database may operate independently or as a component to a mapping system or a GPS system. In the preferred embodiment, there are different traffic monitoring system databases in different towns or cities. As an alternative, however, there can be one centralized database for the entire system.

Figure 2A:
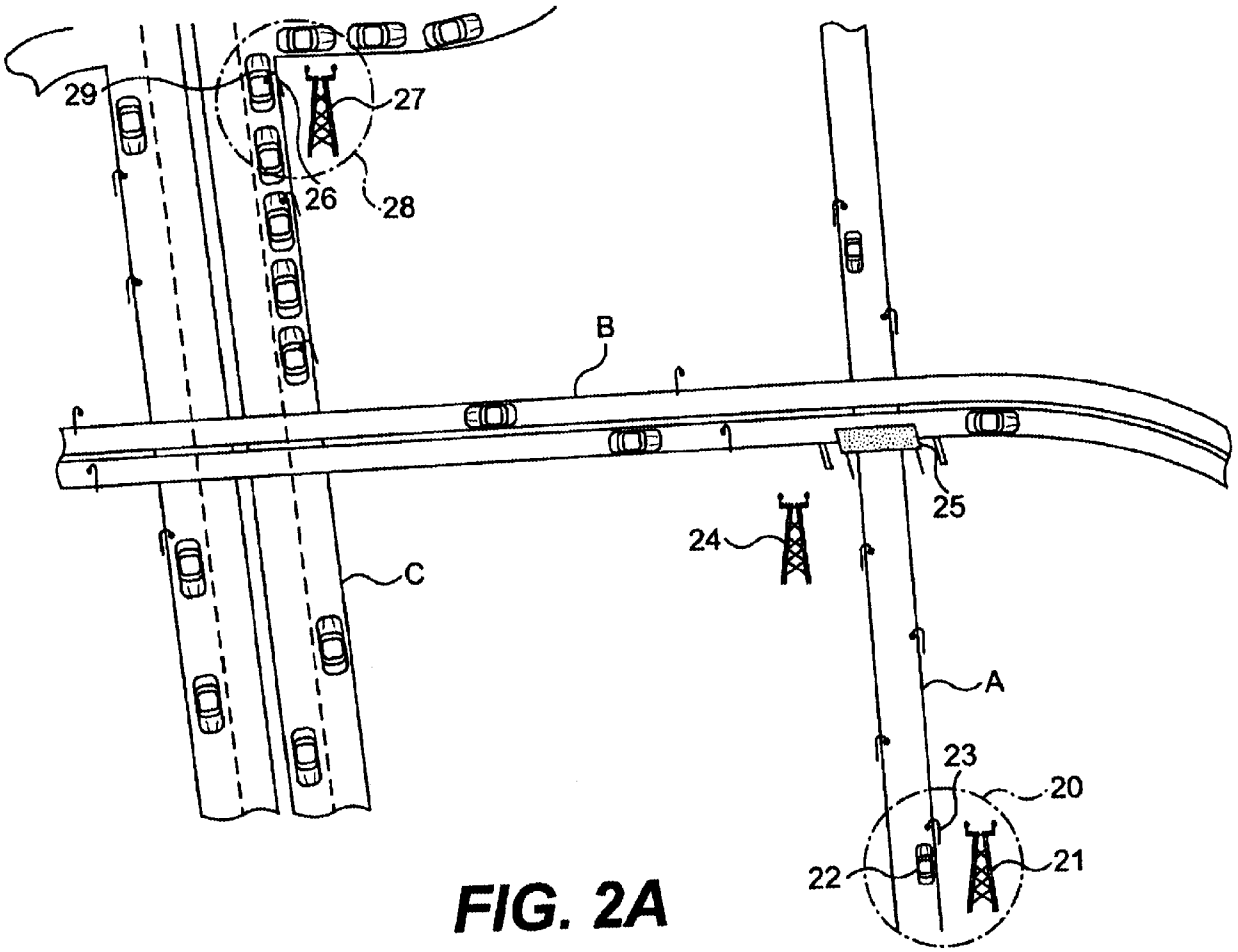
FIG. 2A is a drawing from a top view of a roadway system incorporating the traffic monitoring system according to the preferred embodiment of the present invention.
Figure 2B:
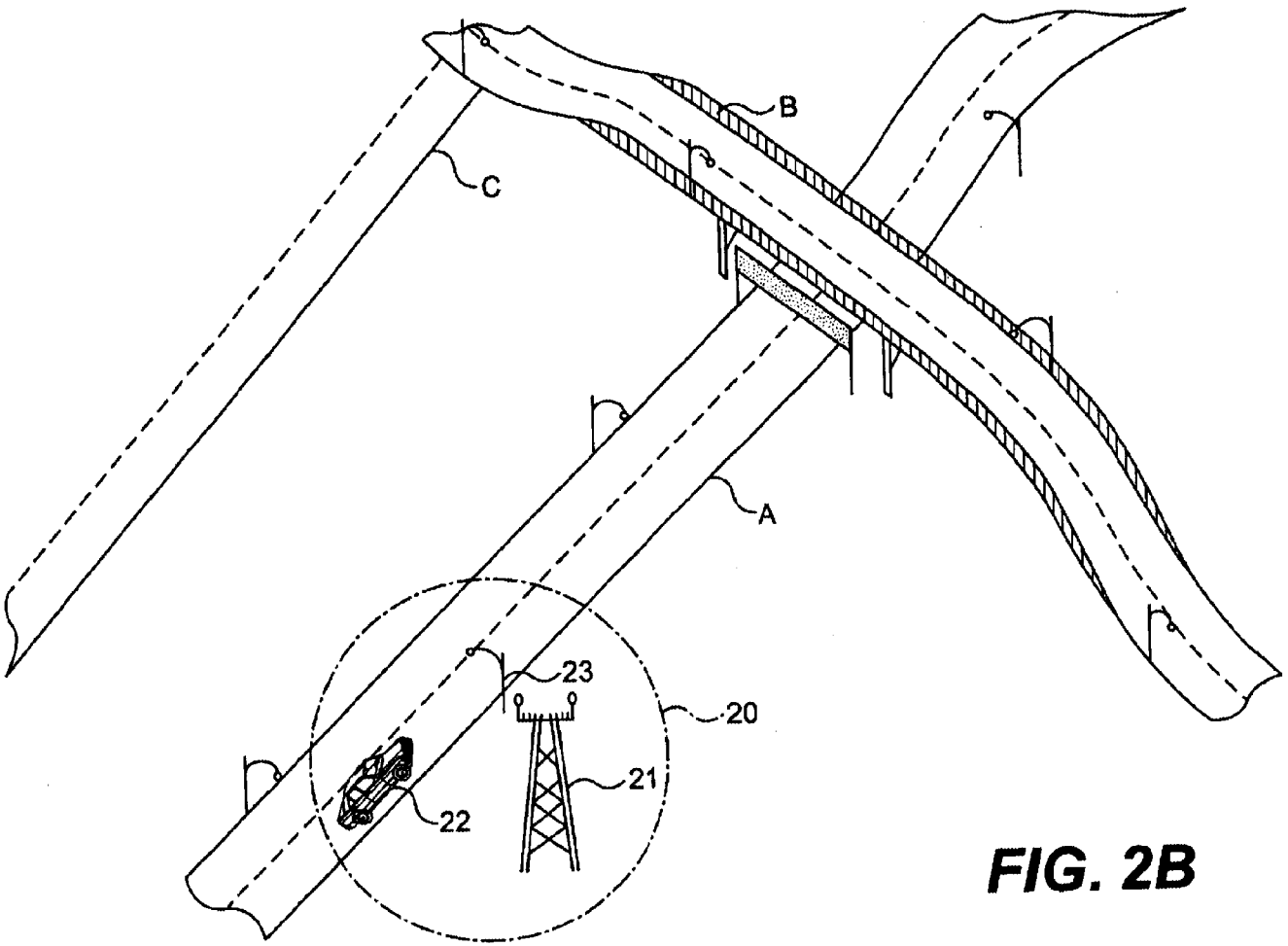
FIG. 2B is a drawing from a perspective view of the roadway system of FIG. 2A incorporating the traffic monitoring system according to the preferred embodiment of the present invention.

FIGS. 2A and 2B illustrate the placement of sensors relative to drivers who access the traffic monitoring system according to the present invention. FIGS. 2A and 2B provide, respectively, an overhead view and a perspective view of a portion of a road network that incorporates a traffic monitoring system. Sensors are provided on street lights and street signs along roads A, B, and C for detecting traffic information. The sensors periodically transmit a signal, which is received by a cell tower in a region near the sensor to communicate the traffic information to a central traffic monitoring database. For example, sensor 23, which is mounted on a street light along road A, establishes a connection with cell tower 21 to transmit traffic information to the central database. As another example, sensor 25, which is mounted on a street sign above road A, establishes a connection with nearby cell tower 24 to transmit the traffic information. The locations and spacings of the sensors depend upon the relative amount of traffic congestion experienced on a particular road, and the level of precision required for useful traffic reporting.

As shown in FIG. 2A, a driver operating automobile 22 within a cell region 20 on road A can request information over the wireless network to access traffic reporting information at a remote location on road C. The driver uses a mobile communications unit to establish a communications link at cell tower 21. The driver then provides a location point for the area of concern. Depending upon the sophistication of the mobile communications unit, this may be performed by speaking, entering text, or selecting from a list of locations. As an example, the system may identify sensor 26, located on a street light pole along road C, as the detector that provides traffic information for the requested location point. The traffic monitoring system database maintains the information transmitted by sensor 26, which is in turn transmitted to the mobile communications unit operated by the driver of automobile 22.

Figure 3:
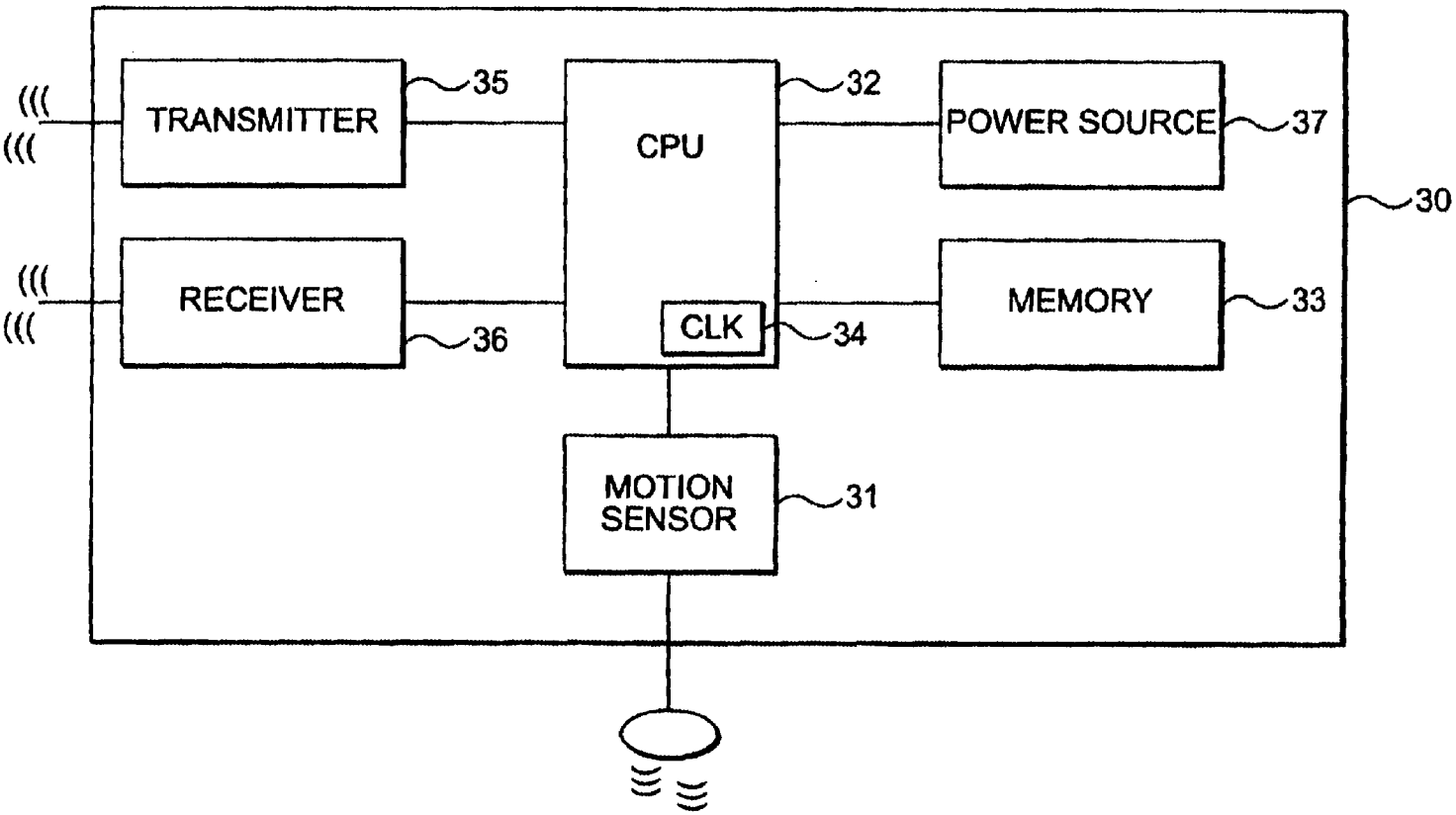
FIG. 3 is a block diagram of a motion sensor according to the preferred embodiment of the present invention.

FIG. 3 provides a schematic diagram of components necessary to perform traffic monitoring in a motion sensor 30. The motion sensor of the preferred embodiment is incorporated within a wireless interactive pager. The motion sensor paging system includes a motion sensor element 31 for detecting speed-of-traffic information along a roadway. The motion sensor element can operate by radar, or by detecting changes in frequency, volume, air movement, light, etc. to detect the speed of motion in any of a variety of known methods. In an alternative embodiment, the motion sensor element can also include an LED and a reflector for detecting the speed of traffic based upon the rate at which a generated light path is broken.

The motion sensor element is connected to CPU 32, which configures the information for transmission. Memory 33, connected to the CPU 32, stores data prior to transmission. Transmitter 35 is connected to CPU 32 to transmit the information detected by the motion sensor to a region cell tower, which is then forwarded to the traffic system database. The CPU includes a clock 34 for timing the transmission of traffic signals to the traffic system database. Receiver 36, connected to CPU 32, receives acknowledgement signals from the cell tower when the data is correctly transmitted.

The CPU in the motion sensor system is also connected to a power source 37 for providing power to the system. In the preferred embodiment, the CPU is powered by solar energy through a solar cell with a rechargeable battery, as is known in the art. As alternative embodiments, the system may be powered by a battery source or by an electrical source. For example, if the motion sensor system is affixed to a street light pole or a lighted road sign, the power source for the motion sensor system could be tapped from the existing electrical wiring arrangement.

The activity detected by the motion sensor element is converted into a digital information signal, which is fed into CPU 32 as a "reading." This information is stored in temporary memory 33. After a period of time, as calculated by a number of clock signals from CPU clock 34, the CPU transmits the reading over transmitter 35.

The motion sensor system can be adapted to operate on an existing cellular packet network, such as the BellSouth MobiText network. If the motion sensor system operates as an interactive pager, the CPU configures the information signal as a data packet or series of packets, having a pager unit identification field and an information field. The configured information is transmitted over transmitter 35 by broadcasting the information signal at a certain frequency. The configured information that is transmitted over transmitter 35 may include: latitude/longitude identification, a sensor number, a speed counter, traffic direction, and/or transmission error correction. The signal is received by a regional cell tower in the vicinity. The cell tower then forwards the information through the communications link, as is known in cellular packet network systems. The cell tower broadcasts an acknowledgement message at a certain frequency when the motion sensor system signal has been received.

The delay period, or time interval by which the motion sensor systems transmit traffic information to the database is determined according to several possible factors. For example, if the motion sensors are to be placed along a well-traveled roadway with highly variable traffic conditions during the "rush hour," the motion sensor systems may be programmed to transmit traffic information relatively often to update the database and provide current and relevant information. In comparison, motion sensors along roadways that do not generally experience variable traffic patterns may update the corresponding database records less frequently.

Because many roadways are known to be busier at certain times, e.g., weekday mornings and early evenings, the corresponding motion sensor systems may be programmed to transmit updates such that the period of time between updates varies according to the time of day. The programmability of the motion sensor systems and the capability for varying the time period between updates allows the motion sensors to convey the maximum amount of useful information to the traffic monitoring database, while minimizing the amount of energy and air time required.

It is also possible to configure the sensors to only transmit information concerning the change in the speed-of-travel along the roadway. In many circumstances, this will decrease the number of bits of data necessary to be transmitted over the wireless network. As a further embodiment, the sensors can be programmed to transmit only when there is an average speed change beyond a certain threshold amount. If the speed of traffic in a particular area remains relatively constant, it may be unnecessary to transmit sensor information at regular, periodic intervals.

Figure 4:
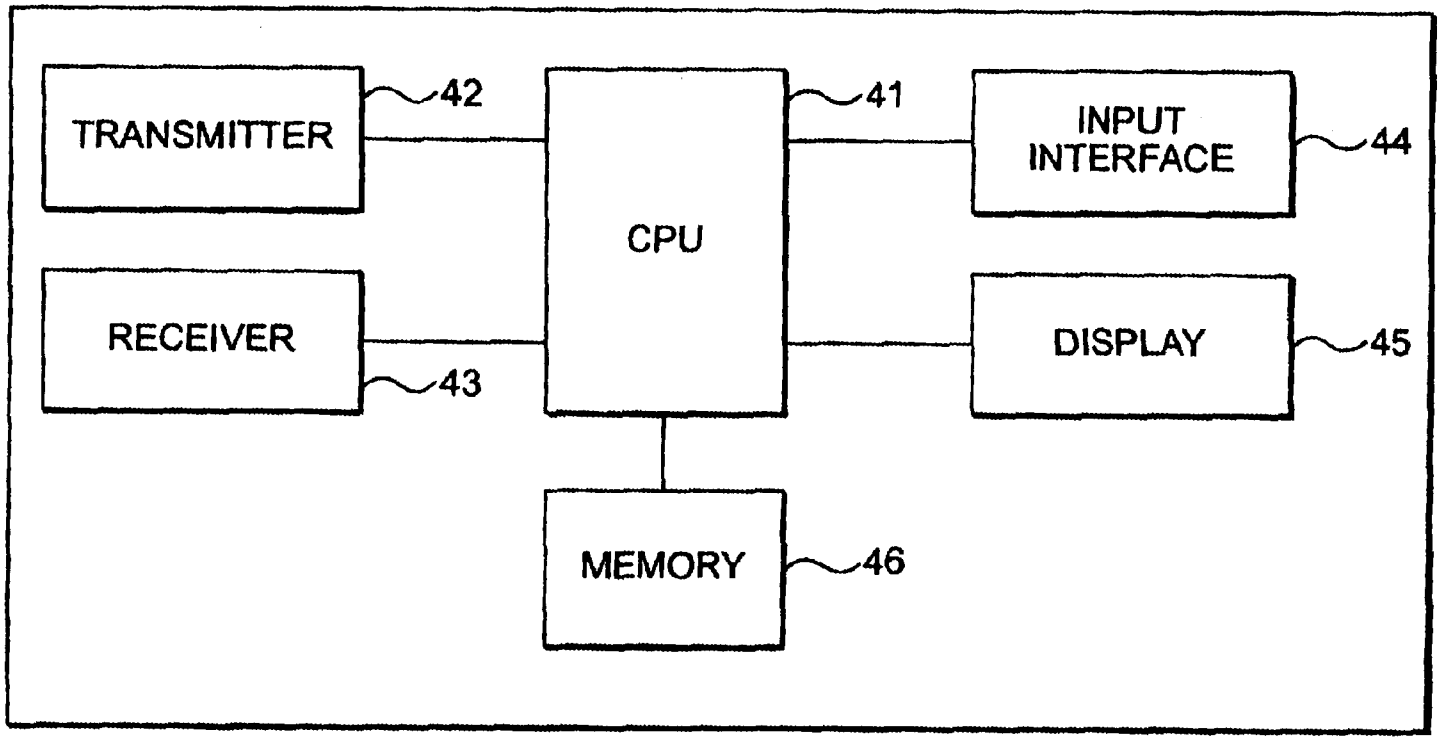
FIG. 4 is a block diagram of a mobile communications unit according to the preferred embodiment of the present invention.

As previously discussed, a subscriber can access the traffic monitoring information via a mobile communications unit. Regardless of the form or type, the mobile communications unit must minimally include, as shown in FIG. 4, a CPU 41, transmitter 42, receiver 43, input interface 44, display 45, and a memory 46. The level of functionality available to the subscriber depends primarily upon the type of input interface and display provided on the subscriber's mobile communication unit.

An interactive pager, such as a pager on the BellSouth MobiText network, has an input interface 44 with an alphanumeric typewriter-type keypad that allows a subscriber to enter data. The subscriber may pre-program the pager by coding one or destination locations and storing the information in memory 46. When using the pager to access traffic conditions, the subscriber then selects from one of the stored destination location codes to transmit a request. By prestoring frequently identified locations, the subscriber can quickly request traffic information, perhaps while operating an automobile. The information is then displayed as a text message. An internet-accessible personal display assistant, or PDA, can communicate with the traffic monitoring system in the same manner as an interactive pager, and may include additional features for the subscriber.

Subscribers can also access traffic monitoring information through the use of a digital cellular mobile telephone. Cellular telephones typically include an alpha-numeric telephone-type keypad by which a subscriber can enter data to be transmitted to the traffic monitoring system. By configuring the traffic monitoring system to include speech recognition capabilities, subscribers may also be able to enter geographical location information by speaking into the handset of the cellular telephone. This allows commuters to benefit from using a more natural interface for supplying traffic information requests while operating an automobile.

The traffic monitoring system can provide the requested traffic monitoring information to a cellular telephone user in one of several different possible formats. Depending upon the sophistication of the cellular telephone display, the traffic monitoring information can be supplied as a text message in the cellular telephone display. Using known text-to-speech synthesis technologies, the traffic monitoring system can also provide the requested traffic monitoring information to a subscriber orally. This allows the subscriber to listen most pertinent traffic conditions while driving.

Figure 5:
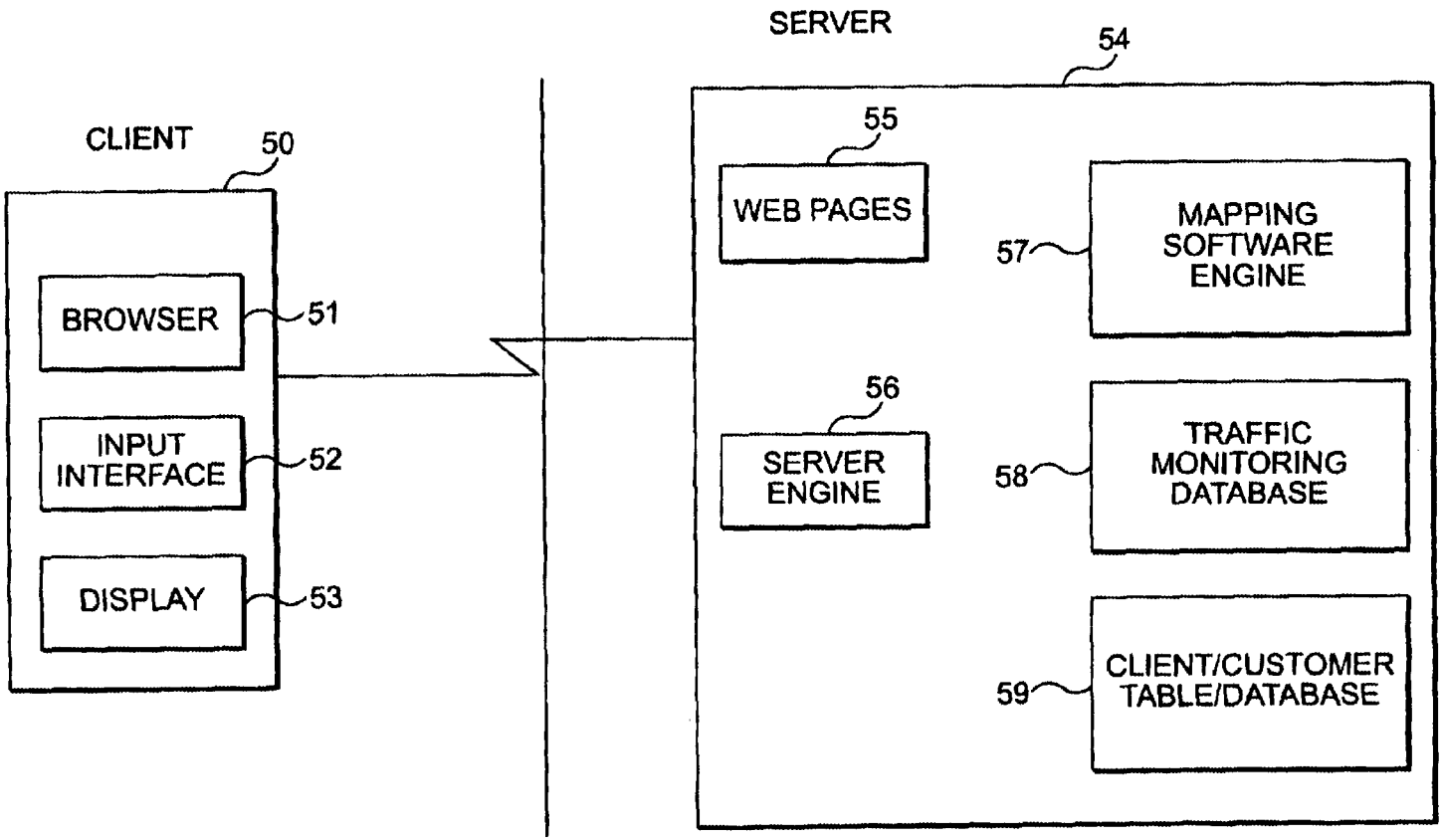
FIG. 5 is a block diagram of a client and server system operating the traffic monitoring system according to the preferred embodiment of the present invention.

As an alternative to accessing the traffic monitoring information from a mobile communications unit, a subscriber can request and receive information directly from a personal computer. FIG. 5 is a block diagram illustrating an embodiment in which a user accesses the traffic monitoring system on-line through the Internet through the World Wide Web. The server system 54 includes a server engine 211 for receiving HTTP requests to access Web pages 55. The mapping software engine 57 is integrated directly within the server 54 of the traffic monitoring system to provide street location and mapping information on the web pages 55. Traffic monitoring database 58 stores the traffic flow information that is provided by the plurality of motion sensors as previously described with reference to FIG. 1. The traffic monitoring information is overlaid onto the mapping information on the web pages 55. The server 54 may also include a client/customer table or database 59 for maintaining a list of subscribers to the traffic monitoring system.

A subscriber to the traffic monitoring system can access customized traffic information via a personal computer 50 with an Internet connection. After providing search location information through input interface 52, web pages 55 are provided from the server to the subscriber's browser 51 and onto display 53. In the preferred embodiment, the subscriber will first be prompted to enter a password identification corresponding to that stored in client/customer table/datbase 59 to gain access to the traffic monitoring system. A subscriber may log into the traffic monitoring website from his home or office before begining a commute, or may use a laptop with wireless communications capabilities to access graphical mapping and traffic information while driving.

Figure 6:
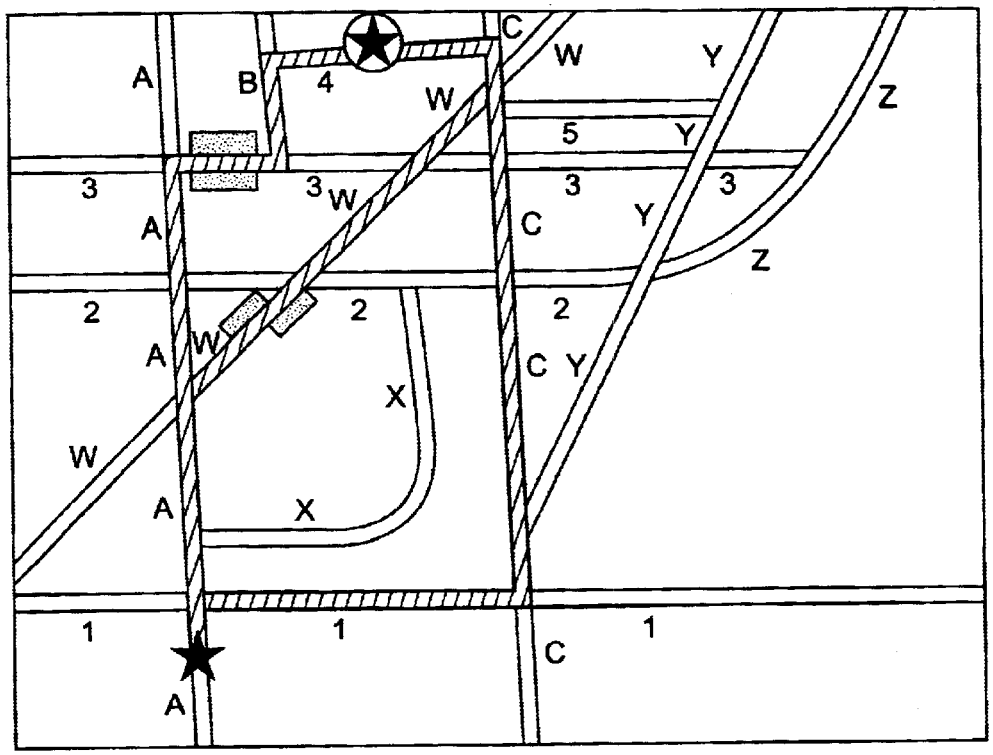
FIG. 6 is an illustration on a display screen for the traffic monitoring system according to the preferred embodiment of the present invention.

FIG. 6 provides a graphical illustration of a display 53 that incorporates both mapping and traffic monitoring information. Horizontal streets are numbered 1, 2, 3, 4, or 5, vertical streets are lettered A, B, or C, and diagonal or curved streets are lettered W, X, Y, or Z. The originating location that is provided by the subscriber is indicated by a star, and the chosen destination location is indicated by a star within a circle. The mapping software determines that there are three possible routes from the originating location to the destination location. The routes are indicated by slashed lines through the streets. In this display, a bold rectangular block surrounding a portion of a street represents an impediment to smooth traffic flow, as determined by a regional motion sensor. The suggested path that avoids the traffic backups is outlined in bold. Note that a computer display that utilizes color would instead be color-coded. For example, each of the possible routes may be in blue, the portions of streets that are blocked could be represented in red, and the suggested route could be represented in green.

In currently available mapping software, a user can seek point-to-point directions for different locations and an estimate of the time required to arrive at the destination. Because conventional mapping software packages do not include speed of traffic flow information, the time estimates that are provided are generally not reliable. By incorporating the information detected by the traffic motion sensors and provided to the traffic monitoring database, the traffic monitoring system of the present invention can provide a more accurate time estimate, because the speed of traffic at points along the driver's intended route are known.

The traffic monitoring database and mapping software can further be incorporated within a mobile GPS system, which may be integrated within a subscriber's automobile. GPS systems are presently available within automobiles that provide real-time mapping information to drivers that is updated as the automobile travels along different roadways. With the traffic monitoring system, the GPS system can display a driver's present location, while also illustrating the relative amount of traffic on the nearby roadways. The traffic monitoring information can be accessed through an interactive pager incorporated within the GPS mobile unit in the automobile. A text-to-speech system can provide oral commands through the speakers of an automobile car radio. With this GPS system, a subscriber can learn of traffic information in the immediate vicinity, at any time. Therefore, the subscriber is able to identify areas of extreme traffic congestion, and can decide upon alternative routes before the subscriber is unnecessarily caught in a delay.

The subscriber's cost incurred for utilizing the traffic monitoring system may depend upon the type of communications equipment that the subscriber utilizes for accessing the traffic monitoring information. The subscriber may be charged only for the airtime rates associated with communicating with the traffic monitoring system using the subscriber's cellular telephone, interactive pager, etc. In such a case, the telecommunications companies include the traffic monitoring service free as a promotion to utilize the mobile communications equipment. As another alternative, a subscriber may be charged for the traffic monitoring information service by a monthly fee or a fee for each service.

As another source of revenue, advertising may also be included in the traffic monitoring information messages. For example, an advertisement may be presented to the subscriber before the traffic information is provided. The advertisements may be automatically selected according to the destination location selected by the user. As another example, the system may select advertisements for restaurants located nearby the selected destination addresses.

Thus, it can be seen that the traffic monitoring system of the present invention can be used in many forms to provide accurate, timely, speed of traffic information specific to a driver's personal commute. The traffic monitoring motion sensors can be located and spaced to ensure that there are no gaps in coverage where traffic delays may occur. The timing of update transmissions by the motion sensors can be adjusted or programmed to account for the variability of traffic or the time of day.

The foregoing disclosure of embodiments of the present invention and specific examples illustrating the present invention have been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claimed appended hereto, and by their equivalents.

What is claimed is:

1. A traffic monitoring system for providing vehicular traffic information, comprising:

a plurality of motion sensors for detecting speed of traffic information along one or more roadways and transmitting the detected information; and a database for receiving and storing the detected speed of traffic information transmitted by the plurality of motion sensors, wherein at least a subset of motion sensors transmit the detected information in programmed periodic intervals, variable according to time, such that motion sensors transmit more frequently during time intervals of historically high traffic volume, and wherein the database is accessible for providing speed of traffic information detected by a selected portion of the motion sensors.

2. The traffic monitoring system according to claim 1, further comprising at least one mobile communications unit for accessing the database through a mobile communications link to receive traffic information for a specified geographical location.

3. The traffic monitoring system according to claim 1, wherein the motion sensors are spaced a distance apart along roadways to measure the speed of traffic at different points along roadways.

4. The traffic monitoring system according to claim 1, wherein different motion sensors transmit the detected information in different periodic intervals from each other, such that motion sensors that are located along roadways having historically highly variable traffic conditions transmit detected information in comparatively shorter periodic intervals.

5. The traffic monitoring system according to claim 1, wherein the motions sensors are powered by solar cells with rechargeable batteries or by batteries.

6. The traffic monitoring system according to claim 1, wherein the motion sensors transmit the detected information over a wireless network.

7. The traffic monitoring system according to claim 6, wherein the wireless network includes a plurality of cell towers for transmitting and receiving radio frequency information within respective cell sites, and the motion sensors transmit the detected information to the respective regional cell tower.

8. The traffic monitoring system according to claim 7, wherein the wireless network is a paging network for transmission of pages of the detected information by the motion sensors.

9. The traffic monitoring system according to claim 1, wherein the database maintains the detected information transmitted by each motion sensor arranged according to the roadway in which the speed of traffic is detected and the location of the sensor on the roadway.

10. The traffic monitoring system according to claim 9, wherein each database record includes a field indicating the time at which the database record was updated.

11. The traffic monitoring system according to claim 9, wherein each database record includes a field indicating whether the speed of traffic detected by the respective sensor is normal.

12. The traffic monitoring system according to claim 9, wherein each database record includes a field indicating a qualitative assessment of the speed of traffic most recently detected by the respective sensor, based upon a history of previous readings detected by the sensor.

13. A motion sensor for monitoring the flow of vehicular traffic along a roadway, comprising:

a central processing unit;

a transmitter; and a motion sensing detector, wherein at periodic intervals that vary according to the time of day, the motion sensor transmits speed of traffic information detected by the detector on a wireless network to a central database.

14. The motion sensor according to claim 13, wherein the motion sensor is an interactive pager.

15. A method for providing vehicular traffic information according to a specified traffic request, comprising the steps of:

receiving speed of traffic information transmitted by a plurality of motion sensors located along one or more roadways corresponding to the specified traffic request, wherein motion sensors transmit at periodic intervals that vary according to the time of day;

storing the traffic information in a database;

determining the traffic information corresponding to the specified traffic request; and communicating the traffic information.

16. The method for providing vehicular traffic information according to claim 15, wherein the traffic information request is transmitted and the traffic information is received over a mobile cellular telephone.

17. The method for providing vehicular traffic information according to claim 15, further comprising the steps of:

determining at least one geographical route for travelling from a starting location to a destination location over navigable roadways;

mapping at least one geographical route; and overlaying the traffic information along with the at least one geographical route, wherein the specified traffic request includes the starting location and destination location.

18. The method for providing vehicular traffic information according to claim 17, wherein the starting location included in the specified traffic request is automatically determined by a GPS system.

19. The method for providing vehicular traffic information according to claim 15, wherein the motion sensors transmit the traffic information at periodic intervals over a wireless network.

20. The method for providing vehicular traffic information according to claim 15, wherein the traffic information is communicated over a wireless network.

21. The method for providing vehicular traffic information according to claim 15, wherein the traffic information is communicated to a Internet-capable browser through an Internet communications link.

22. A method for transmitting vehicular traffic information from a motion sensor located along a roadway to a centralized database over a wireless communications network, wherein the motion sensor includes a memory for storing at least one speed measurement, comprising the steps of:

detecting an updated speed measurement along the roadway in the motion sensor;

calculating a difference value between the updated speed measurement and a previous speed measurement stored in the motion sensor memory;

transmitting the difference value to the centralized database; and replacing the previous speed measurement with the updated speed measurement, wherein updated speed measurements are detected upon periodic intervals.

23. The method of claim 22, wherein the periodic intervals vary according to the time of day or day of week.

24. The method of claim 22, wherein the periodic intervals vary according to the time of day and day of week.

25. A method for transmitting vehicular traffic information from a motion sensor located along a roadway to a centralized database over a wireless communications network, wherein the motion sensor includes a memory for storing at least one speed measurement, comprising the steps of:

detecting an updated speed measurement along the roadway in the motion sensor;

calculating a difference value between the updated speed measurement and a previous speed measurement stored in the motion sensor memory; and if an absolute value of the difference value is greater than a threshold value stored in the motion sensor, then transmitting the difference value to the centralized database; and replacing the previous speed measurement with the updated speed measurement, wherein updated speed measurements are detected upon periodic intervals.

26. The method of claim 25, wherein the threshold value varies according to the time of day or day of week.

27. The method of claim 25, wherein the threshold value varies according to the time of day and day of week.

28. The method of claim 25, wherein the period intervals vary according to the time of day or day of week.

29. The method of claim 25, wherein the period intervals vary according to the time of day and day of week.

* * * * *